US011059296B2

(12) United States Patent
Kosugi

(10) Patent No.: US 11,059,296 B2
(45) Date of Patent: Jul. 13, 2021

(54) LIQUID CONTAINER AND LIQUID EJECTING SYSTEM

(71) Applicant: SEIKO EPSON CORPORATION, Tokyo (JP)

(72) Inventor: Yasuhiko Kosugi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/823,086

(22) Filed: Mar. 18, 2020

(65) Prior Publication Data

US 2020/0298577 A1 Sep. 24, 2020

(30) Foreign Application Priority Data

Mar. 19, 2019 (JP) ..... JP2019-051068

(51) Int. Cl.
*B41J 2/175* (2006.01)

(52) U.S. Cl.
CPC ..... *B41J 2/17526* (2013.01); *B41J 2/17543* (2013.01)

(58) Field of Classification Search
CPC ..... B41J 2/17526; B41J 2/17543; B41J 2002/17569; B41J 2/17566; B41J 2/17546; B41J 2/17553; B41J 2/1753; B41J 2002/17516; B41J 2/17513; B41J 2/1752; B41J 2/17503; B41J 2/01; G03G 21/1867; G03G 21/1871
USPC ..... 347/86
See application file for complete search history.

(56) References Cited

U.S. PATENT DOCUMENTS

2015/0273846 A1* 10/2015 Kubota ..... B41J 2/17526 347/86
2019/0039380 A1* 2/2019 Shinada ..... B41J 2/175

FOREIGN PATENT DOCUMENTS

JP 2005-262823 A 9/2005

* cited by examiner

*Primary Examiner* — Huan H Tran
*Assistant Examiner* — Alexander D Shenderov
(74) *Attorney, Agent, or Firm* — Oliff PLC

(57) ABSTRACT

A liquid container has: a liquid storage section that stores a liquid; a surrounding wall that envelops the liquid storage section; a liquid supply opening formed in the surrounding wall, the liquid supply opening enabling the liquid to be supplied from the liquid storage section to the liquid introducing section; a first storage device that can be electrically coupled to the holder-side terminal through a first contact section; and a second storage device that can be electrically couple to the holder-side terminal through a second contact section. Even when the liquid container is rotated by 180 degrees around the central axis of the liquid supply opening and is mounted in the holder, either of the first storage device and second storage device is coupled to the holder-side terminal. Information about the amount of the liquid is stored in both the first storage device and the second storage device.

8 Claims, 11 Drawing Sheets

FIG. 6

| | FIRST STORAGE DEVICE | SECOND STORAGE DEVICE | |
|---|---|---|---|
| | UNIQUE INFORMATION | UNIQUE INFORMATION | |
| | FIRST IDENTIFICATION INFORMATION | SECOND IDENTIFICATION INFORMATION | |
| SA1 | FIRST STORAGE AREA (FIRST TOTAL) | THIRD STORAGE AREA (FIRST TOTAL) | SA3 |
| SA2 | SECOND STORAGE AREA (SECOND TOTAL) | FOURTH STORAGE AREA (SECOND TOTAL) | SA4 |

FIG. 7

| MAIN BODY MEMORY |
|---|
| UNIQUE INFORMATION |
| FIRST TOTAL |
| SECOND TOTAL |
| TOTAL AMOUNT OF INK CONSUMPTION |

FIG. 8

| CHANGE | STORAGE DEVICE COUPLED TO MAIN BODY | FIRST STORAGE DEVICE | | SECOND STORAGE DEVICE | | MAIN BODY MEMORY | | |
|---|---|---|---|---|---|---|---|---|
| | | FIRST STORAGE AREA (FIRST TOTAL) | SECOND STORAGE AREA (SECOND TOTAL) | THIRD STORAGE AREA (FIRST TOTAL) | FOURTH STORAGE AREA (SECOND TOTAL) | FIRST TOTAL | SECOND TOTAL | TOTAL AMOUNT OF INK CONSUMPTION |
| NEW CARTRIDGE | – | 0 | 0 | 0 | 0 | 0 | 0 | 0 |
| MOUNTED | FIRST | 0 | 0 | 0 | 0 | 0 | 0 | 0 |
| INK CONSUMED | FIRST | $\alpha 1$ | 0 | 0 | 0 | $\alpha 1$ | 0 | $\alpha 1$ |
| REMOVED | – | $\alpha 1$ | 0 | 0 | 0 | $\alpha 1$ | 0 | $\alpha 1$ |
| REVERSELY MOUNTED | SECOND | $\alpha 1$ | 0 | $\alpha 1$ | 0 | $\alpha 1$ | 0 | $\alpha 1$ |
| INK CONSUMED | SECOND | $\alpha 1$ | 0 | $\alpha 1$ | $\beta 1$ | $\alpha 1$ | $\beta 1$ | $\alpha 1+\beta 1$ |
| REMOVED | – | $\alpha 1$ | 0 | $\alpha 1$ | $\beta 1$ | $\alpha 1$ | $\beta 1$ | $\alpha 1+\beta 1$ |
| REVERSELY MOUNTED | FIRST | $\alpha 1$ | $\beta 1$ | $\alpha 1$ | $\beta 1$ | $\alpha 1$ | $\beta 1$ | $\alpha 1+\beta 1$ |
| INK CONSUMED | FIRST | $\alpha 2$ | $\beta 1$ | $\alpha 1$ | $\beta 1$ | $\alpha 2$ | $\beta 1$ | $\alpha 2+\beta 1$ |
| REMOVED | – | $\alpha 2$ | $\beta 1$ | $\alpha 1$ | $\beta 1$ | $\alpha 2$ | $\beta 1$ | $\alpha 2+\beta 1$ |
| REVERSELY MOUNTED | SECOND | $\alpha 2$ | $\beta 1$ | $\alpha 2$ | $\beta 1$ | $\alpha 2$ | $\beta 1$ | $\alpha 2+\beta 1$ |
| INK CONSUMED | SECOND | $\alpha 2$ | $\beta 1$ | $\alpha 2$ | $\beta 2$ | $\alpha 2$ | $\beta 2$ | $\alpha 2+\beta 2$ |
| REMOVED | – | $\alpha 2$ | $\beta 1$ | $\alpha 2$ | $\beta 2$ | $\alpha 2$ | $\beta 2$ | $\alpha 2+\beta 2$ |

LIQUID CONTAINER AND LIQUID EJECTING SYSTEM

The present application is based on, and claims priority from JP Application Serial Number 2019-051068, filed Mar. 19, 2019, the disclosure of which is hereby incorporated by reference herein in its entirety.

BACKGROUND

1. Technical Field

The present disclosure relates to a liquid container and a liquid ejecting system.

2. Related Art

In relation to a liquid container, JP-A-2005-262823, for example, discloses a system in which, when a predetermined time has elapsed after the mounting of an ink cartridge in a carriage in a printer, the ink cartridge is reversely mounted.

In the technology described in JP-A-2005-262823, however, an adequate study has not been made for the management of the amount of ink in the ink cartridge to be reversely mounted. In view of this, there is a demand for a technology with which, even when the orientation of a liquid container holding a liquid such as an ink is reversed, the correct amount of liquid can be grasped.

SUMMARY

An aspect of the present disclosure provides a liquid container that, in a liquid ejecting apparatus having a holder, a liquid introducing section, and a holder-side terminal, is detachably mounted in the holder. This liquid container has: a liquid storage section storing a liquid; a surrounding wall enveloping the liquid storage section; a liquid supply opening formed in the surrounding wall, the liquid supply opening being configured to supply the liquid from the liquid storage section to the liquid introducing section; a first storage device configured to electrically couple to the holder-side terminal through a first contact section; and a second storage device configured to electrically couple to the holder-side terminal through a second contact section. The first contact section and second contact section are disposed at positions on the surrounding wall, the first contact section and second contact section being symmetric at the positions with respect to the central axis of the liquid supply opening. Even when the liquid container is rotated by 180 degrees around the central axis and is mounted in the holder, either of the first storage device and second storage device is coupled to the holder-side terminal. Information about the amount of the liquid is stored in both the first storage device and the second storage device.

BRIEF DESCRIPTION OF THE DRAWINGS

FIG. 6 indicates what is stored in a first storage device and a second storage device.

FIG. 7 indicates what is stored in a main body memory.

FIG. 8 indicates how data stored in the first storage device and second storage device is changed.

DESCRIPTION OF EXEMPLARY EMBODIMENTS

A. First Embodiment

Figure 1:
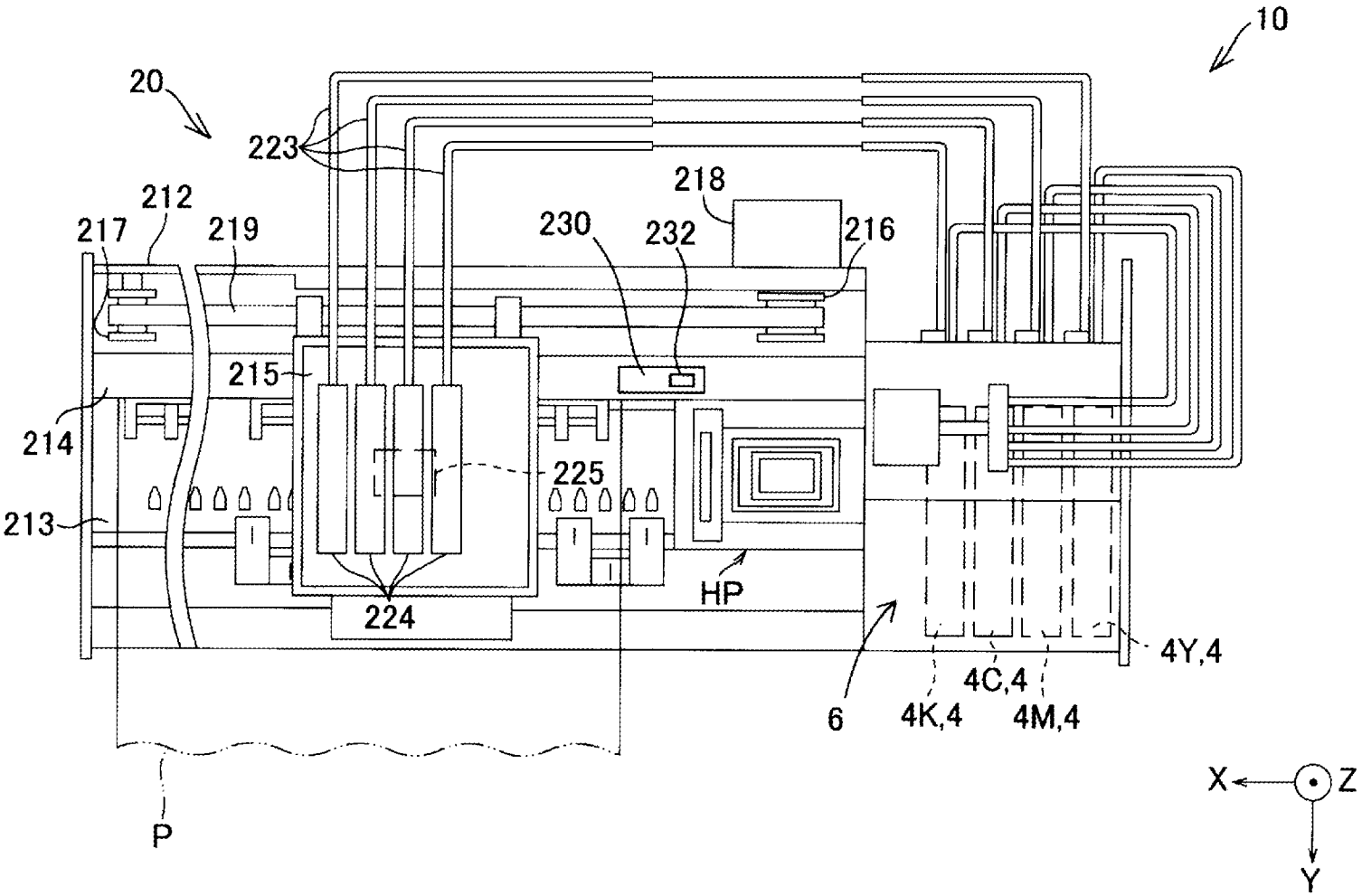
FIG. 1 schematically illustrates the structure of a liquid ejecting system.

FIG. 1 schematically illustrates the structure of a liquid ejecting system 10 in a first embodiment of the present disclosure. In FIG. 1, three space axes, X, Y and Z axes, which are mutually orthogonal, are indicated. Directions indicated by the arrows of the X, Y and Z axes respectively indicate positive directions along the X, Y, and Z axes. The positive directions along the X, Y, and Z axes are respectively represented as the +X, +Y, and +Z directions. Directions opposite to the directions indicated by the arrows of the X, Y and Z axes respectively indicate negative directions along the X, Y, and Z axes. The negative directions along the X, Y, and Z axes are respectively represented as the −X, −Y, and −Z directions. When it does not matter whether directions along the X, Y, and Z axes are positive or negative, these directions are respectively referred to simply as the X, Y, and Z directions. This is also true for the subsequent drawings and the description below. The X, Y, and Z axes indicated in the other drawings respectively correspond to the X, Y, and Z axes in FIG. 1. In this embodiment, the Z axis is along the direction of gravity or the vertical direction and the −Z direction is the direction of gravity or the vertical direction.

The liquid ejecting system 10 has a printer 20 used as a liquid ejecting apparatus and four cartridges 4C, 4M, 4Y, and 4K used as liquid containers. The printer 20 is an ink jet printer that ejects ink used as a liquid from a recording head 225 used as a liquid ejecting head. The four cartridges 4C, 4M, 4Y, and 4K are denoted by reference numeral 4 when they are used without being distinguished. While the liquid ejecting system 10 and printer 20 are in use, the +Z direction is upward in the vertical direction and the −Z direction is downward in the vertical direction. In a state in which the liquid ejecting system 10 and printer 20 are in use, the liquid ejecting system 10 is mounted in a horizontal mounting surface defined by the X and Y directions.

The printer 20 has a main body case 212 shaped like a substantially rectangular box and a controller 230 disposed in the main body case 212. The controller 230 is structured as a computer that has a central processing unit (CPU), a random-access memory (RAM), a non-volatile memory, and the like. The non-volatile memory included in the controller 230 will be referred to below as the main body memory 232. The controller 230 controls various operations including the print operation of the printer 20, and transmits and receives various signals to and from the cartridge 4. The controller 230 also has a function to manage the amount of ink consumption for each cartridge 4 by calculating the amount of ink consumption according to the number of ink droplets ejected from the recording head 225 and the weight of ink per droplet.

A platen 213 is provided in the main body case 212 so as to be along the X direction, which is the longitudinal direction of the main body case 212. The platen 213 is a pedestal that supports recording paper P toward which ink droplets are ejected. Recording paper P is fed onto the platen 213 by a paper feed mechanism (not illustrated) along a sub-scanning direction orthogonal to a main scanning direction. In this embodiment, the main scanning direction is the X direction and the sub-scanning direction is the Y direction.

The printer 20 further has a guide shaft 214, a carriage 215, a driving pulley 216, a driven pulley 217, and a carriage motor 218.

The guide shaft 214 is positioned more on the +Z direction than is the platen 213. The guide shaft 214 is a rod-like member along the main scanning direction. The guide shaft 214 supports the carriage 215 so as to be movable along the guide shaft 214.

The driving pulley 216 and driven pulley 217 are rotatably disposed at positions corresponding to both ends of the guide shaft 214, the positions being more on the −Y direction than is the guide shaft 214, one pulley at each end. The carriage motor 218 is linked to the driving pulley 216. An endless timing belt 219 supporting the carriage 215 is stretched between the driving pulley 216 and the driven pulley 217. Therefore, when driven by the carriage motor 218, the carriage 215 can bidirectionally move in the main scanning direction along the guide shaft 214. Although, in this embodiment, the recording head 225 is structured so as to be movable in the main scanning direction, this is not a limitation. For example, the recording head 225 may be a line head that extends along the X direction and is located at a fixed position.

The printer 20 further has a holder 6 in which the cartridges 4 are detachably mounted. The holder 6 is also referred to as the cartridge mounting section. The holder 6 is disposed in the main body case 212. Part of the main body case 212 is structured so as to be openable and closable. When this openable and closable part is opened, the cartridges 4 can be mounted in and demounted from the holder 6. Although, in this embodiment, the holder 6 is disposed in the main body case 212, this is not a limitation. For example, the whole or part of the holder 6 may be disposed outside the main body case 212.

The four cartridges 4C, 4M, 4K, and 4Y are detachably mounted in the holder 6. The cartridge 4K stores a black ink. The cartridge 4C stores a cyan ink. The cartridge 4M stores a magenta ink. The cartridge 4Y stores a yellow ink. Each ink is a pigment ink that includes pigment particles and a dispersant such as water. The printer 20 has four liquid flow paths 223 in correspondence to the four cartridges 4C, 4M, 4Y, and 4K. Each liquid flow path 223 is a tube. The cartridge 4 and recording head 225 communicate with each other through the relevant liquid flow path 223. The type of ink is not limited to a pigment ink. For example, the cartridge 4 may store a dye ink.

When mounted in the holder 6, the cartridge 4 is coupled to the upstream end of the relevant liquid flow path 223. The downstream end of each liquid flow path 223 is coupled to the upstream end of a valve unit 224 corresponding to the liquid flow path 223, the valve unit 224 being mounted on the carriage 215. The downstream end of the valve unit 224 is coupled to the recording head 225 disposed on the bottom surface of the carriage 215. That is, ink stored in the cartridge 4 passes through the relevant liquid flow path 223 and is supplied to the recording head 225.

A home position HP, to which the recording head 225 retracts, is provided between the holder 6 and the platen 213. Before the start of printing, for example, cleaning for the recording head 225 and other various types of maintenance processing are performed at this home position HP.

Figure 2:
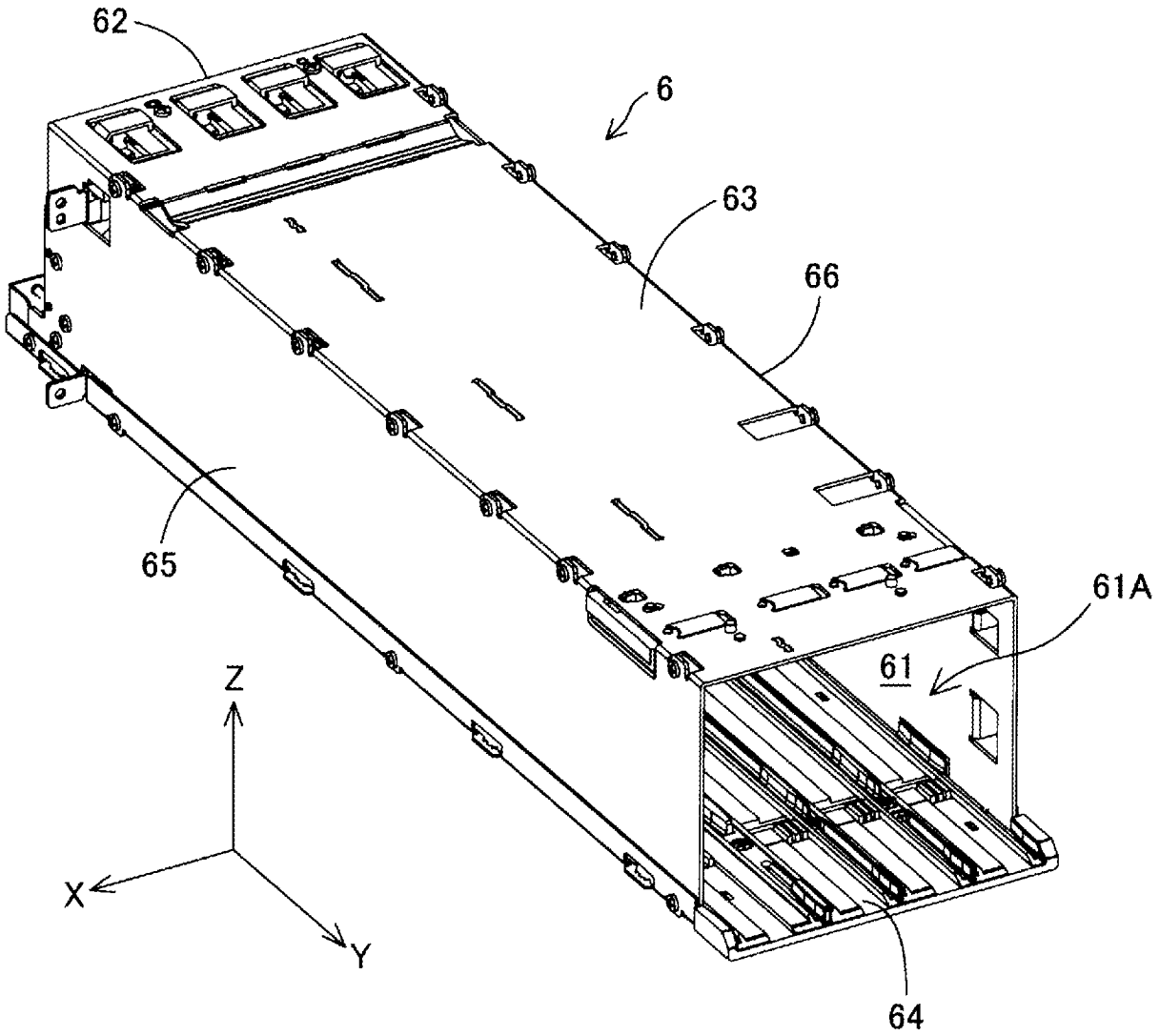
FIG. 2 is a first perspective view illustrating the outside shape of a holder.
Figure 3:
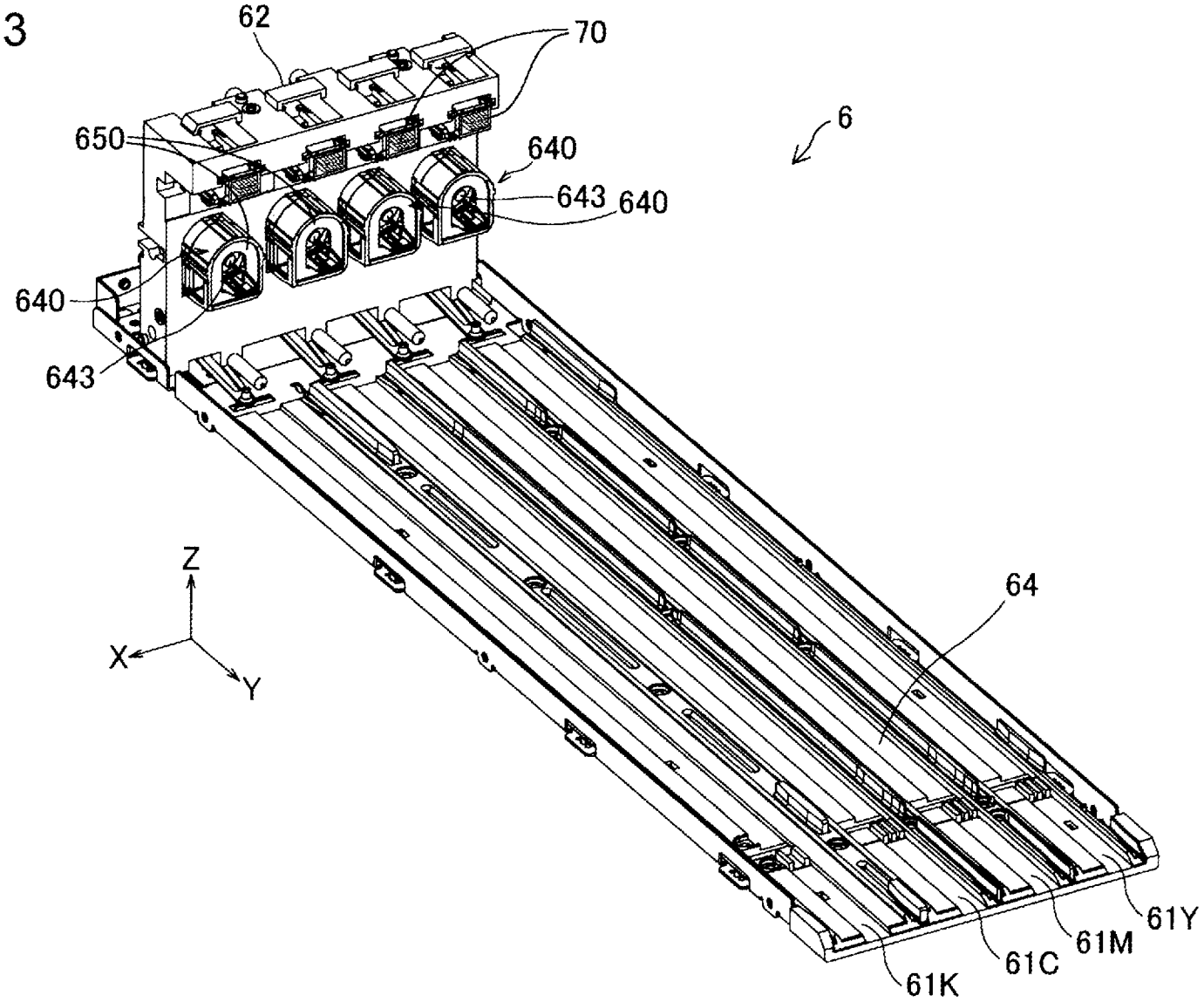
FIG. 3 is a second perspective view illustrating the outside shape of a holder.

FIG. 2 is a first perspective view illustrating the outside shape of the holder 6. FIG. 3 is a second perspective view illustrating the outside shape of the holder 6. In FIG. 3, some of the constituent elements are omitted so that the interior of the structure of the holder 6 is visible. The cartridge 4 is mounted in the holder 6 in the −Y direction. The cartridge 4 is removed from the holder 6 in the +Y direction.

In the holder 6, a cartridge accommodating chamber 61, in which the cartridges 4 are accommodated, is formed with five walls described below as illustrated in FIG. 2. The cartridge accommodating chamber 61 is substantially in a rectangular parallelepiped shape. A portion, in the cartridge accommodating chamber 61, that accommodates one of the four cartridges 4C, 4M, 4Y, and 4K is also referred to as a slot. Specifically, a portion that accommodates the cartridge 4K is referred to as a slot 61K, a portion that accommodates the cartridge 4C is referred to as a slot 61C, a portion that accommodates the cartridge 4M is referred to as a slot 61M, and a portion that accommodates the cartridge 4Y is referred to as a slot 61Y, as illustrated in FIG. 3.

The holder 6 has an apparatus-side front wall 62, a first apparatus-side side wall 63, and a second apparatus-side side wall 64. The holder 6 also has a third apparatus-side side wall 65 and a fourth apparatus-side side wall 66. The cartridge accommodating chamber 61 is defined by these five walls 62, 63, 64, 65, and 66. Each of the five walls 62, 63, 64, 65, and 66 has a substantially rectangular outside shape. The cartridge accommodating chamber 61 has an opening 61A formed opposite to the apparatus-side front wall 62.

The apparatus-side front wall 62 is positioned more on the −Y-direction side than is the cartridge accommodating chamber 61 as illustrated in FIGS. 2 and 3. While the printer 20 is in use, the apparatus-side front wall 62 is a vertical wall.

The holder 6 has liquid supply mechanisms 640 as illustrated in FIG. 3. Each liquid supply mechanism 640 is disposed on the apparatus-side front wall 62. One liquid supply mechanism 640 is provided for each of the slots 61C, 61M, 61Y, and 61K in correspondence to one of the cartridges 4C, 4M, 4Y, and 4K.

The liquid supply mechanism 640 has a cover member 650 and a liquid introducing section 643. The liquid introducing section 643 is used so that ink in the cartridge 4 flows toward the printer 20. The liquid introducing section 643 is in a tubular shape having a central axis extending in the Y direction. The liquid introducing section 643 is coupled to the cartridge 4.

The cover member 650 encloses the circumference of the liquid introducing section 643 with the central axis of the liquid introducing section 643 taken as the center. The cover member 650 reduces the possibility that ink flies to the outside during the mounting or demounting of the cartridge 4. The cover member 650 is urged in the +Y direction by an urging member (not illustrated), such as a coil spring, included in the liquid supply mechanism 640. The cover member 650 is structured so as to be movable along the Y direction. During the mounting of the cartridge 4, when the cartridge 4 abuts the cover member 650, the cover member 650 moves in the −Y direction against the force of the urging member. Thus, the end of the liquid introducing section 643 in the +Y direction protrudes in the +Y direction beyond the cover member 650 and is coupled to the cartridge 4.

Terminal units 70 are provided on the top of the apparatus-side front wall 62. One terminal unit 70 is provided for each of the slots 61C, 61M, 61Y, and 61K in correspondence to one of the cartridges 4C, 4M, 4Y, and 4K. Each terminal unit 70 has a plurality of holder-side terminals 71 (see FIG. 5) electrically coupled to the controller 230. When the cartridge 4 is mounted in the holder 6, each holder-side terminal 71 electrically comes into contact with a contact section provided on the cartridge 4. In another embodiment, the terminal unit 70 may be disposed on the bottom of the apparatus-side front wall 62.

Figure 4:
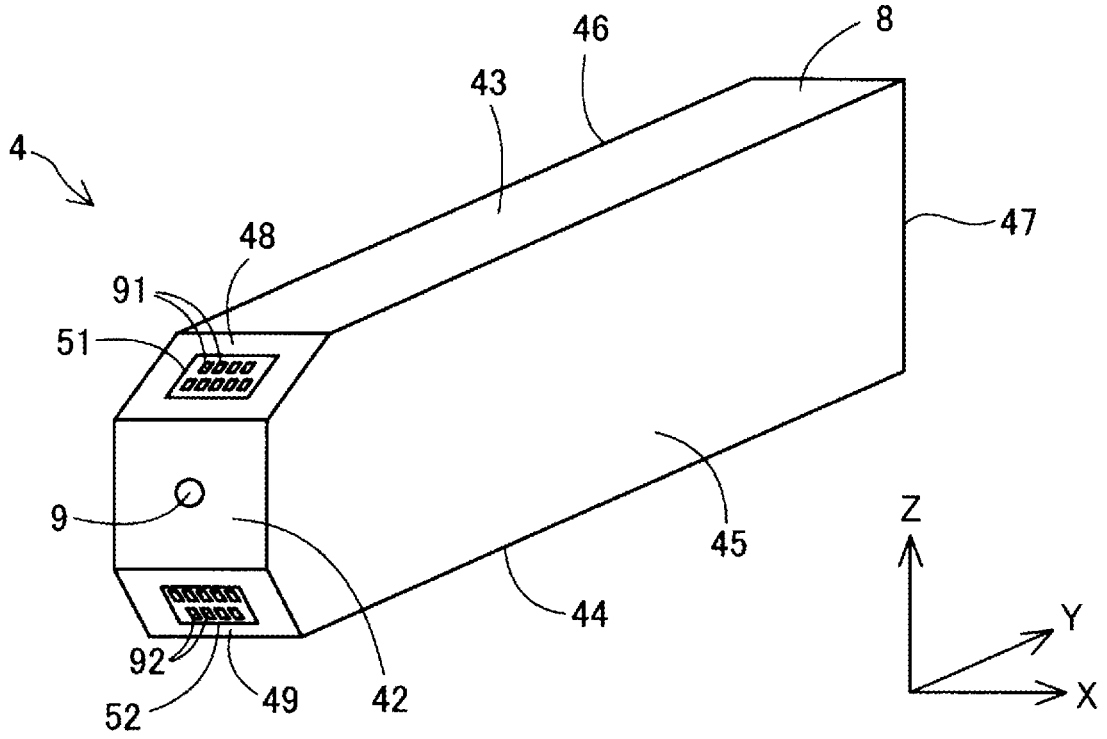
FIG. 4 is a perspective view of a cartridge.
Figure 5:
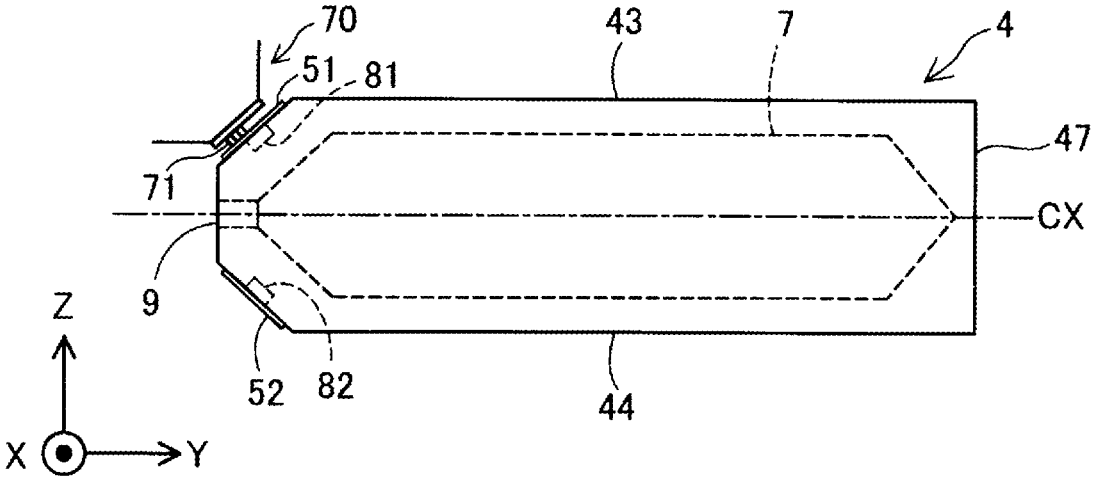
FIG. 5 is a side view of the cartridge.

FIG. 4 is a perspective view of the cartridge 4. FIG. 5 is a side view of the cartridge 4. The cartridge 4 is a liquid container from which ink used as a liquid can be supplied to the recording head 225 in the printer 20. In FIGS. 4 and 5, the X, Y, and Z axes are indicated in a state in which the cartridges 4 are mounted in the printer 20. In this embodiment, the cartridges 4C, 4M, 4Y, and 4K have the same structure.

As illustrated in FIG. 4, the cartridge 4 has a shape resulting from diagonally cutting the upper corner and lower corner of the end of the case of the cartridge 4 in the −Y direction, the case being substantially in a rectangular parallelepiped shape. In this embodiment, the dimension of the cartridge 4 in the Y direction is largest followed by the dimension in the Z direction and the dimension in the X direction in that order. The X direction is also referred to as the width direction of the cartridge 4. The Z direction is also referred to as the height direction of the cartridge 4. The Y direction is also referred to as the depth direction of the cartridge 4.

The cartridge 4 has a liquid storage section 7, surrounding walls 8, a liquid supply opening 9, a first substrate 51, and a second substrate 52, as illustrated in FIGS. 4 and 5. The cartridge 4 is structured so that even when it is rotated by 180 degrees around the central axis CX of the liquid supply opening 9 in a cylindrical shape, the cartridge 4 is mountable in the holder 6. In the description below, an orientation in which the first substrate 51 is positioned above the second substrate 52 will be referred to as a first orientation of the cartridge 4 and an orientation in which the second substrate 52 is positioned above the first substrate 51 will be referred to as a second orientation of the cartridge 4. In FIGS. 4 and 5, the first orientation of the cartridge 4 is illustrated.

The liquid storage section 7 internally stores ink as a liquid. In this embodiment, the liquid storage section 7 is a flexible bag-like ink pack.

The liquid supply opening 9 is formed in one of the surrounding walls 8. Through the liquid supply opening 9, ink can be supplied from the liquid storage section 7 to the liquid introducing section 643 provided in the printer 20. A valve mechanism is provided in the liquid supply opening 9. When the liquid introducing section 643 is coupled to the liquid supply opening 9, this valve mechanism is opened. In this embodiment, the central axis CX of the liquid supply opening 9 extends along the Y direction, in which the cartridge 4 is mounted. That is, in this embodiment, the central axis CX extends in a direction along a horizontal plane with the cartridge 4 mounted in the holder 6.

The surrounding walls 8, which form an outer shell that envelops the liquid storage section 7, are formed by, for example, being molded from a synthetic resin such as polypropylene or polystyrene. The surrounding walls 8 are composed of a front wall 42, in which the liquid supply opening 9 is formed, a rear wall 47, an upper wall 43, a bottom wall 44, a first side wall 45, a second side wall 46, a first inclined wall 48, and a second inclined wall 49. The front wall 42 and rear wall 47 face each other in the Y direction, the front wall 42 being positioned on the −Y-direction side, the rear wall 47 being positioned on the +Y-direction side. The upper wall 43 and bottom wall 44 face each other in the Z direction, the upper wall 43 being positioned on the +Z-direction side, the bottom wall 44 being positioned on the −Z-direction side. The first side wall 45 and second side wall 46 face each other in the X direction, the first side wall 45 being positioned on the +X-direction side, the second side wall 46 being positioned on the −X-direction side. The first inclined wall 48 is positioned between the front wall 42 and the upper wall 43. The first inclined wall 48 is inclined with respect to the mounting direction. In the first orientation, a vector along a perpendicular dropped from a point in space toward the first inclined wall 48 has a component oriented in the −Z direction and a component oriented in the +Y direction. The second inclined wall 49 is positioned between the front wall 42 and the bottom wall 44. The second inclined wall 49 is inclined with respect to the mounting direction. In the first orientation, a vector along a perpendicular dropped from a point in space toward the second inclined wall 49 has a component oriented in the +Z direction and a component oriented in the +Y direction.

The first substrate 51 is disposed on the first inclined wall 48, and the second substrate 52 is disposed on the second inclined wall 49. As illustrated in FIG. 5, a first storage device 81 is provided on the rear surface of the first substrate 51 and a second storage device 82 is provided on the rear surface of the second substrate 52. As illustrated in FIG. 4, a plurality of first contacts 91 are provided on the front surface of the first substrate 51 and a plurality of second contacts 92 are provided on the front surface of the second substrate 52. Each first contact 91 occupies an area included in a terminal used to electrically couple the first storage device 81 to the relevant holder-side terminal 71. Each second contact 92 occupies an area included in a terminal used to electrically couple the second storage device 82 to the relevant holder-side terminal 71.

In the first orientation, the first contacts 91 are electrically coupled to the holder-side terminals 71. Therefore, the first storage device 81 is electrically coupled to the holder-side terminals 71, enabling various types of data to be transmitted and received between the first storage device 81 and the controller 230. In the second orientation, the second contacts 92 are electrically coupled to the holder-side terminals 71. Therefore, the second storage device 82 is electrically coupled to the holder-side terminals 71, enabling various types of data to be transmitted and received between the second storage device 82 and the controller 230.

FIG. 6 indicates what is stored in the first storage device 81 and second storage device 82. The first storage device 81 and second storage device 82 store the same unique information, which is unique to the cartridge 4. The unique information about the cartridge 4 includes, for example, the model number of the cartridge 4, the manufacturing date of the cartridge 4, information representing the amount of stored ink. The first storage device 81 and second storage device 82 each store information by which either of them, whichever is appropriate, can be identified. Specifically, the first storage device 81 stores first identification information that identifies the first storage device 81, and the second storage device 82 stores second identification information that identifies the second storage device 82. The first identification information and second identification information each represent the orientation of the cartridge 4. Specifically, when the first identification information is read by the controller 230, the mounting orientation of the cartridge 4 is the first orientation; when the second identification information is read by the controller 230, the mounting orientation of the cartridge 4 is the second orientation.

The first storage device 81 includes a first storage area SA1 and a second storage area SA2. The second storage device 82 includes a third storage area SA3 and a fourth storage area SA4. The first storage area SA1 and third storage area SA3 each store a first total, which is the total amount of ink consumed from when the first storage device 81 was coupled to the holder-side terminals 71. The second storage area SA2 and fourth storage area SA4 each store a second total, which is the total amount of ink consumed from when the second storage device 82 was coupled to the holder-side terminals 71. The sum of the first total and second total is the amount of ink consumed in the whole of the cartridge 4.

FIG. 7 indicates what is stored in the main body memory 232. The main body memory 232 stores unique information read by the cartridge 4 mounted in the holder 6, stores the first total, which is the total amount of ink consumed in the cartridge 4 in the first orientation and second total, which is the total amount of ink consumption in the second orientation, and further stores the sum of the first total and second total as the whole amount of ink consumption. The controller 230 calculates the amount of ink remaining in the cartridge 4 from the whole amount of ink consumption. When the amount of remaining ink falls to or below a reference value, the controller 230 displays a prompt to replace the cartridge 4 on a display device or the like. The data indicated in FIG. 7 is stored in the main body memory 232 for each slot in the cartridge accommodating chamber 61.

FIG. 8 indicates how data stored in the first storage device 81 and second storage device 82 is changed. Specifically, FIG. 8 indicates data stored in the first storage area SA1 to the fourth storage area SA4 when a cycle of the mounting of the cartridge 4 in the holder 6, ink consumption, the removal of the cartridge 4, and the reversing of the orientation of the cartridge 4 is performed four times. As illustrated in FIG. 8, when a new cartridge 4 is first mounted in the holder 6 in the first orientation, the first storage device 81 is coupled to the controller 230, and then ink is consumed, the amount, calculated by the controller 230, of ink consumption is recorded in the first storage area SA1 in the first storage device 81 as a first total $\alpha 1$. This first total $\alpha 1$ is recorded in the main body memory 232 as well.

Next, when the cartridge 4 is removed from the holder 6, is reversed to the second orientation, and is mounted in the holder 6 again, the second storage device 82 is coupled to the controller 230. Then, the first total al stored in the main body memory 232 is copied to and recorded in the third storage area SA3 in the second storage device 82. When ink is consumed in the second orientation, the amount of ink consumption in the second orientation is recorded in the fourth storage area SA4 in the second storage device 82 as a second total $\beta 1$. This second total $\beta 1$ is recorded in the main body memory 232 as well.

Furthermore, when the cartridge 4 is removed from the holder 6, is reversed to the first orientation, and is mounted in the holder 6 again, the first storage device 81 is coupled to the controller 230. Then, the second total $\beta 1$ stored in the main body memory 232 is copied to and recorded in the second storage area SA2 in the first storage device 81. When ink is consumed in the first orientation, a first total $\alpha 2$ calculated by adding the amount of ink consumption after the reversal to the first orientation to the first total $\alpha 1$ is recorded in the first storage area SA1 in the first storage device 81. This first total $\alpha 2$ is recorded in the main body memory 232 as well.

Furthermore, when the cartridge 4 is removed from the holder 6, is reversed to the second orientation, and is mounted in the holder 6 again, the second storage device 82 is coupled to the controller 230. Then, the first total $\alpha 2$ stored in the main body memory 232 is copied to and recorded in the third storage area SA3 in the second storage device 82. When ink is consumed in the second orientation, a second total $\beta 2$ calculated by adding the amount of ink consumption after the reversal to the second orientation to the second total $\beta 1$ is recorded in the fourth storage area SA4 in the second storage device 82. This second total $\beta 2$ is recorded in the main body memory 232 as well.

Since the data stored in the first storage device 81, second storage device 82, and main body memory 232 is updated according to the mounting orientation of the cartridge 4 as described above, the amount of ink consumed in the whole of the cartridge 4 can be correctly managed in the main body memory 232 as the total amount of ink consumption. Processing to achieve this update processing will be described below by using a flowchart.

Figure 9:
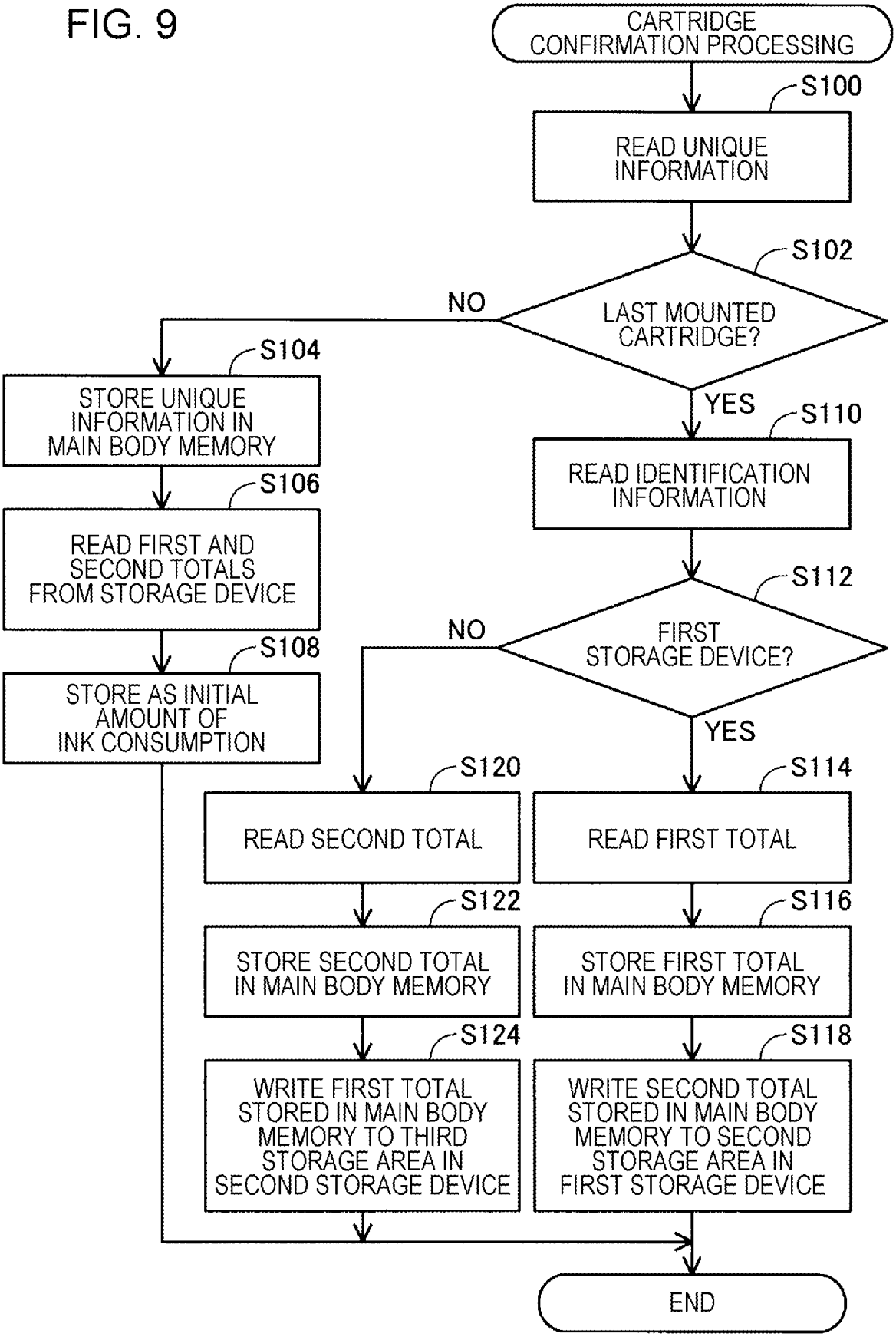
FIG. 9 is a flowchart in cartridge confirmation processing.

FIG. 9 is a flowchart in cartridge confirmation processing executed by the controller 230 in the printer 20. This processing is executed when the controller 230 detects that the cartridge 4 has been mounted in the holder 6. A decision about the detection of the mounting of the cartridge 4 is made according to, for example, whether the controller 230 has become ready for communication with the first storage device 81 or second storage device 82. This processing is executed for each slot in the cartridge accommodating chamber 61.

When a cartridge 4 is mounted in the holder 6, the controller 230 reads unique information about the cartridge 4 from the storage device equipped with the cartridge 4 in step S100. The controller 230 then decides in step S102 whether the cartridge 4 is the cartridge 4 mounted last time, according to the read unique information. When the read unique information is different from the unique information already recorded in the main body memory 232, the controller 230 decides that a cartridge 4 that was not mounted last time has been mounted, after which the controller 230 records the read unique information in the main body memory 232 in step S104 and reads the first total and second total from the storage device equipped with the cartridge 4 in step S106. When the cartridge 4 is a new one, the first total and second total are each zero. In step S108, the controller 230 records the first total and second total, which are both zero, in the main body memory 232 as the initial amount of ink consumption.

When, in step S102, the unique information read from the storage device equipped with the cartridge 4 is the same as the unique information already stored in the controller 230, the controller 230 decides that the cartridge 4 that was mounted last time has been mounted, after which the controller 230 reads identification information from the storage device equipped with the cartridge 4 in step S110. The controller 230 then decides in step S112 whether the storage device coupled to the controller 230 is the first storage device 81, according to the identification information.

When the controller 230 decides in step S112 that the storage device coupled to the controller 230 is the first storage device 81, the mounting orientation of the cartridge 4 is the first orientation. In this case, the controller 230 reads the first total from the first storage area SA1 in the first storage device 81 in step S114, and records the first total in the main body memory 232 in step S116. In step S118, the controller 230 further writes the second total, recorded in the main body memory 232, in the second orientation to the second storage area SA2 in the first storage device 81.

When, in step S112, the controller 230 decides that the storage device coupled to the controller 230 is not the first storage device 81, that is, the storage device is the second storage device 82, the mounting orientation of the cartridge 4 is the second orientation. In this case, the controller 230 reads the second total, which is the amount of ink consumption in the second orientation, from the fourth storage area SA4 in the second storage device 82 in step S120, and records the second total in the main body memory 232 in step S122. In step S124, the controller 230 further writes the first total, which is the amount of ink consumption in the first orientation, recorded in the main body memory 232 to the third storage area SA3 in the second storage device 82.

In cartridge confirmation processing described above, when the cartridge 4 is mounted in the holder 6, data stored in the main body memory 232 can be updated with the first total or second total stored in the storage device equipped with the cartridge 4. The amount, stored in the main body memory 232, of ink consumption, that is, the total amount of ink consumed in the last mounting orientation can be copied to the storage device equipped with the cartridge 4.

Figure 10:
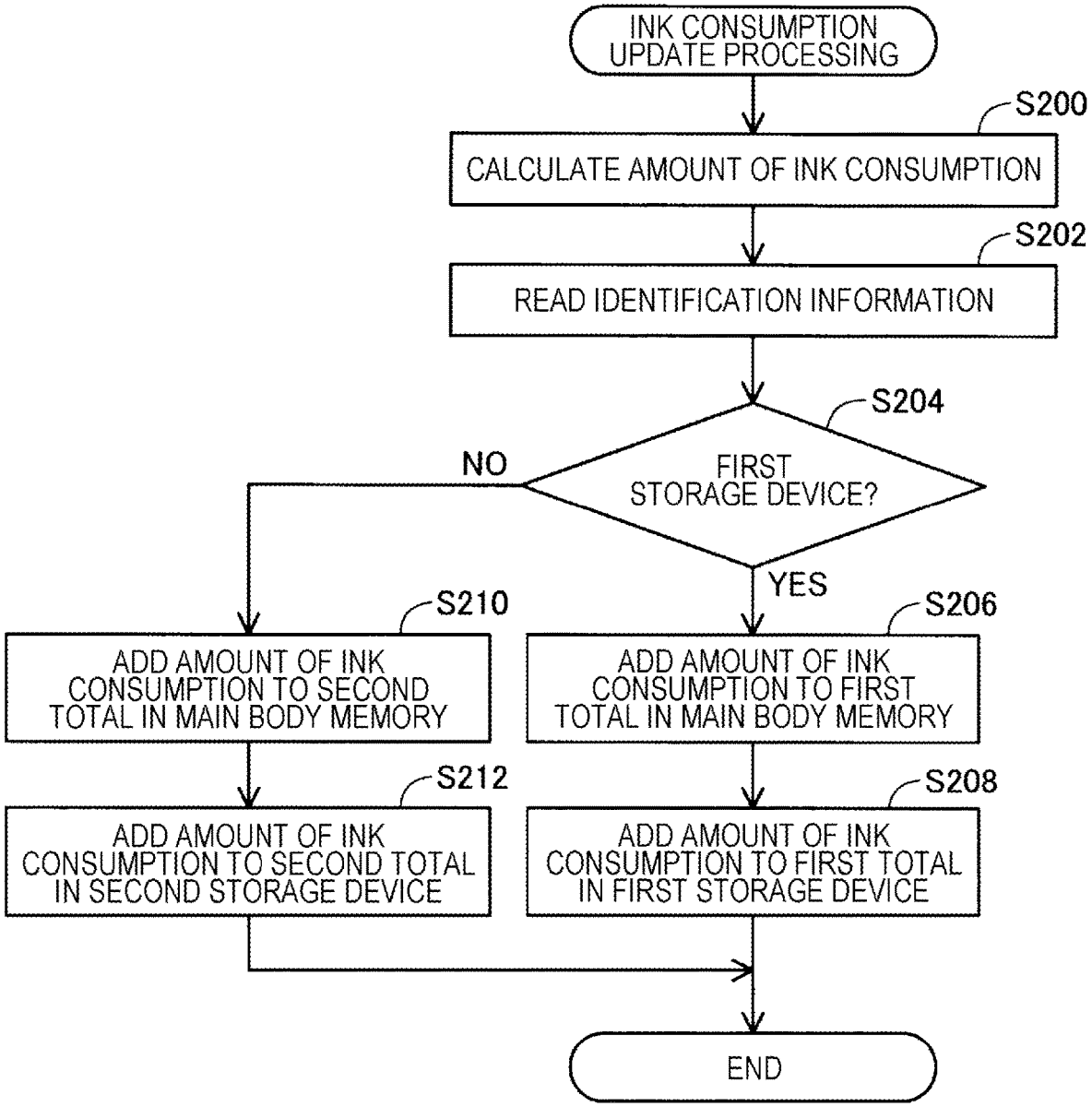
FIG. 10 is a flowchart in ink consumption update processing.

FIG. 10 is a flowchart in ink consumption update processing executed by the controller 230 in the printer 20. This processing is executed when, for example, the printer 20 has completed a print job or the power supply is turned off.

In step S200, the controller 230 calculates the amount of ink consumed from when the last ink consumption update processing is terminated until the recent ink consumption update processing starts. The controller 230 then reads identification information from the storage device equipped with the cartridge 4 currently mounted in the holder 6 in step S202, after which the controller 230 decides in step S204 whether the storage device that is currently ready for communication with the controller 230 is the first storage device 81 according to the identification information.

When the storage device coupled to the controller 230 is the first storage device 81, the controller 230 adds the amount, calculated in step S200, of ink consumption to the first total stored in the main body memory 232 to update the first total in the main body memory 232 in step S206. In step S208, the controller 230 also adds the amount, calculated in step S200, of ink consumption to the first total recorded in the first storage area SA1 in the first storage device 81 to update the first total in the first storage device 81.

When the storage device coupled to the controller 230 is the second storage device 82, the controller 230 adds the amount, calculated in step S200, of ink consumption to the second total stored in the main body memory 232 to update the second total in the main body memory 232 in step S210. In step S212, the controller 230 also adds the amount, calculated in step S200, of ink consumption to the second total recorded in the fourth storage area SA4 in the second storage device 82 to update the second total in the second storage device 82.

In ink consumption update processing described above, the total amount of ink consumption, the total being stored in the main body memory 232 and the first storage device 81 or second storage device 82 equipped with the cartridge 4 mounted in the holder 6, can be appropriately updated. When cartridge confirmation processing illustrated in FIG. 9 is executed before the ink consumption update processing, the reading of identification information in step S202 may be omitted because identification information has been already read in step S110 illustrated in FIG. 9.

With the liquid ejecting system 10 described above, even when the cartridge 4 is rotated by 180 degrees around the central axis CX of the liquid supply opening 9 and is mounted in the holder 6, either of the first storage device 81 and second storage device 82 is coupled to the holder-side terminals 71. The first total and second total, each of which represents the total amount of ink consumption in one mounting orientation of the cartridge 4, are stored in each of the first storage device 81 and second storage device 82. Even when the cartridge 4 is reversely mounted in the holder 6, therefore, the amount of ink remaining in the liquid storage section 7 can be correctly grasped. In this embodiment, the first total and second total are stored not only in the main body memory 232 but also in each of the first storage device 81 and second storage device 82. Even when the cartridge 4 is mounted in another printer, therefore, the amount of ink in the cartridge 4 can be correctly grasped in the other printer.

In this embodiment, the central axis CX of the liquid supply opening 9 extends in a direction along a horizontal plane with the cartridge 4 mounted in the holder 6. When the cartridge 4 is rotated by 180 degrees around the central axis CX, therefore, ink in the liquid storage section 7 can be efficiently agitated. This can improve print quality. In particular, when a pigment ink or disperse dye ink in which a color material relatively easily settles is stored in the cartridge 4, the above structure is effective. Also in this embodiment, even when the cartridge 4 is reversely mounted in a state in which ink in the cartridge 4 has not been completely consumed, the total amount of ink consumption in each mounting orientation can be appropriately managed by executing cartridge confirmation processing in FIG. 9. Therefore, the user can agitate ink at a desired time.

In this embodiment, the first storage device 81 includes the first storage area SA1 that records the first total, which is the total amount of ink consumed in the first orientation and the second storage area SA2 that stores the second total, which is the total amount of ink consumption in the second orientation. Similarly, the second storage device 82 includes the third storage area SA3 that records the first total in the first orientation and the fourth storage area SA4 that stores the second total in the second orientation. Therefore, both the first total and second total can be recorded in each of the first storage device 81 and second storage device 82. Even when the mounting orientation of the cartridge 4 in the holder 6 is reversed, therefore, the amount of liquid remaining in the liquid storage section 7 can be correctly grasped.

In this embodiment, when the first total is stored in the first storage area SA1 with the first storage device 81 coupled to the holder-side terminals 71 and then the second storage device 82 is coupled to the holder-side terminals 71 as a result of the reversal of the mounting orientation, the first total is stored in the third storage area SA3 in the second storage device 82 as well. When the second total is stored in the fourth storage area SA4 with the second storage device 82 coupled to the holder-side terminals 71 and then the first storage device 81 is coupled to the holder-side terminals 71 as a result of the reversal of the mounting orientation, the second total is stored in the second storage area SA2 in the first storage device 81 as well. Even when the cartridge 4 is reversed and is mounted again, therefore, the amount of ink in the liquid storage section 7 can be correctly grasped.

In this embodiment, the first total and second total for the amount of ink consumption are calculated in the printer 20 and are written to each of the first storage device 81 and second storage device 82 through the holder-side terminals 71. Therefore, the cartridge 4 does not need a sensor or the like that is used to measure the amount of ink. This enables the structure of the cartridge 4 to be simplified.

In this embodiment, the first storage device 81 stores first identification information that identifies the first storage device 81, and the second storage device 82 stores second identification information that identifies the second storage device 82. This enables the printer 20 to easily determine the mounting orientation of the cartridge 4.

In this embodiment, the first storage device 81 and second storage device 82 store the same unique information, which is unique to the cartridge 4. This enables the printer 20 to correctly indentify the cartridge 4 regardless of the mounting orientation of the cartridge 4.

B. Other Embodiments

B-1

In the embodiment described above, the first contact 91 and second contact 92 have been respectively positioned on the first inclined wall 48 and second inclined wall 49 of the cartridge 4. However, this positioning of the first contact 91 and second contact 92 is not a limitation. As long as the positional relationship between the first contact 91 and the second contact 92 remains the same even after the cartridge 4 has been rotated by 180 degrees around the central axis CX of the liquid supply opening 9, the first contact 91 and second contact 92 may be disposed at positions as indicated in, for example, FIGS. 11 to 16. FIGS. 11 to 16 respectively illustrate the front surface of cartridges 4*a* to 4*f* substantially in a rectangular parallelepiped shape and their side surface. In these drawings, the position of the first substrate 51 having the first contact 91 and the position of the second substrate 52 having the second contact 92 are hatched.

Figure 11:
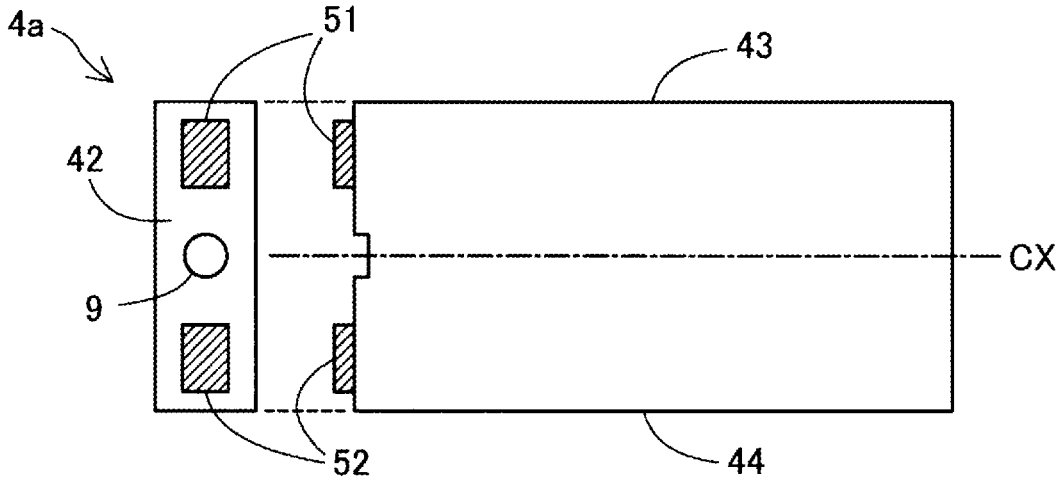
FIG. 11 illustrates an example of the layout of substrates in another cartridge.

In the example in FIG. 11, on the front wall 42 of the cartridge 4*a*, the first substrate 51 and second substrate 52 are disposed at positions between which the liquid supply opening 9 is formed and that are aligned in the Z direction.

Figure 12:
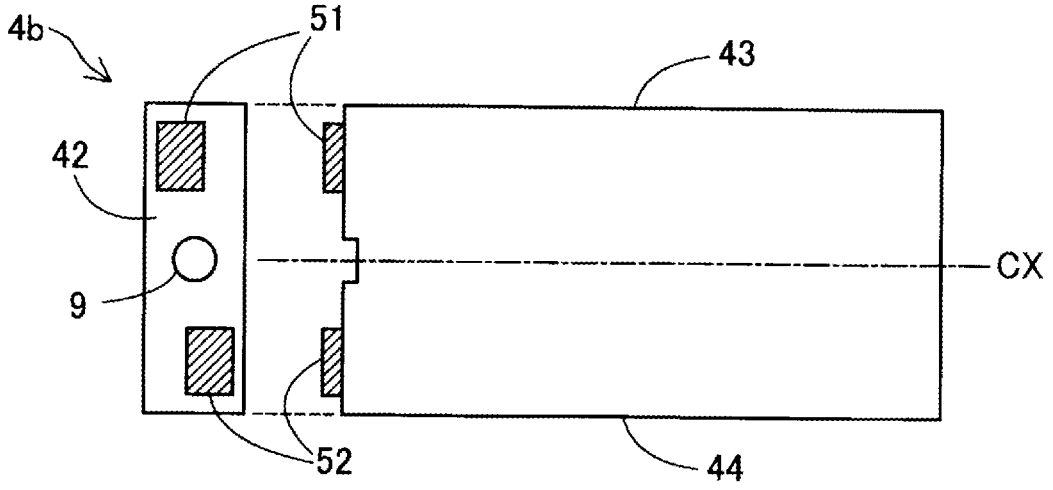
FIG. 12 illustrates an example of the layout of substrates in another cartridge.

In the example in FIG. 12, on the front wall 42 of the cartridge 4*b*, the first substrate 51 and second substrate 52 are disposed at positions that are point-symmetric with respect to the liquid supply opening 9.

Figure 13:
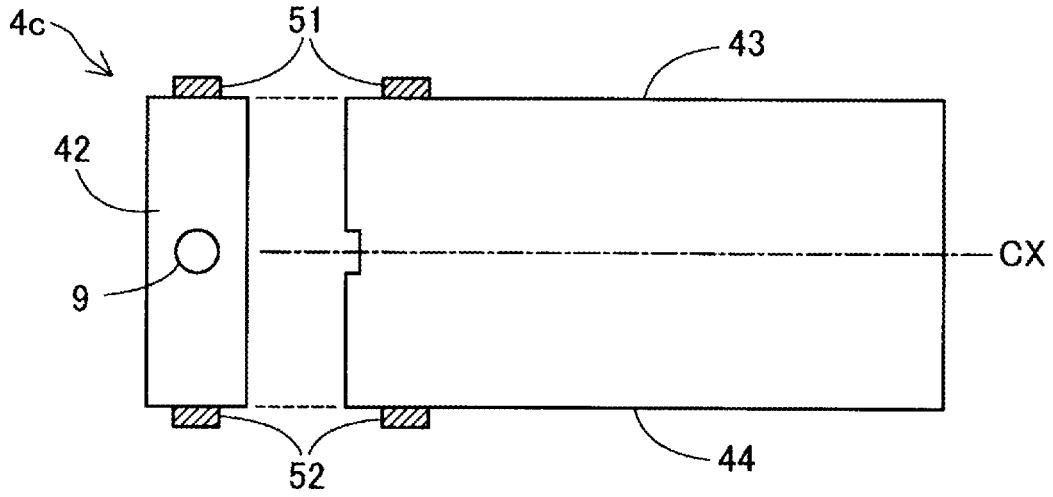
FIG. 13 illustrates an example of the layout of substrates in another cartridge.

In the example in FIG. 13, the first substrate 51 is disposed on the upper wall 43 of the cartridge 4*c* and the second substrate 52 is disposed on the bottom wall 44 so that the positions of these substrates are the same when viewed from above.

Figure 14:
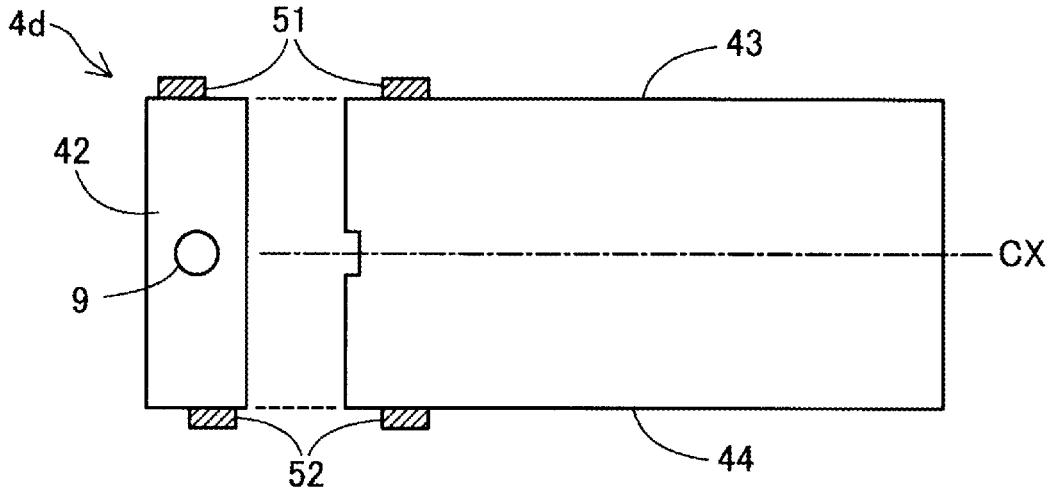
FIG. 14 illustrates an example of the layout of substrates in another cartridge.

In the example in FIG. 14, the first substrate 51 is disposed on the upper wall 43 of the cartridge 4*d* and the second substrate 52 is disposed on the bottom wall 44 so that the distances from the front wall 42 to these substrates are the same and that the positions of these substrates are point-symmetric with respect to the liquid supply opening 9 when viewed from the same side as the front wall 42.

Figure 15:
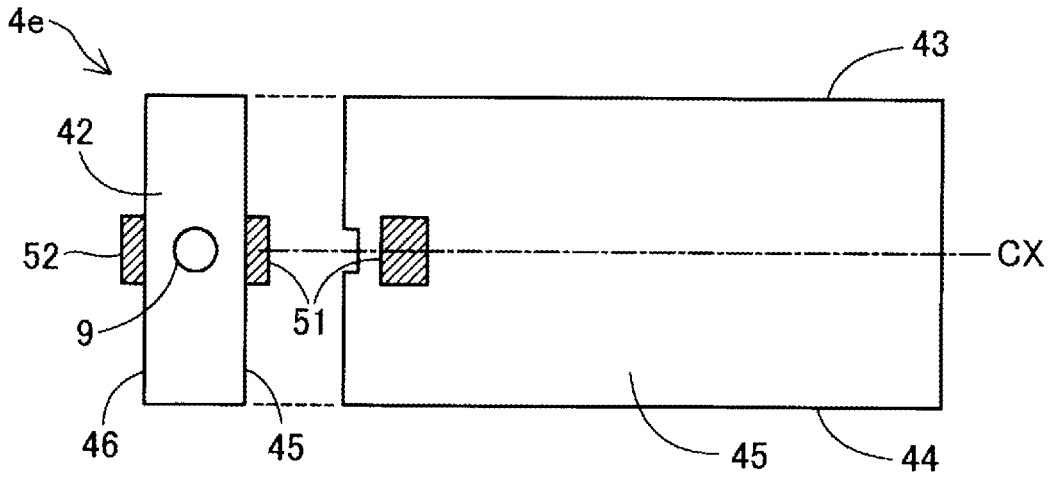
FIG. 15 illustrates an example of the layout of substrates in another cartridge.

In the example in FIG. 15, the first substrate 51 is disposed on the first side wall 45 of the cartridge 4*e* and the second substrate 52 is disposed on the second side wall 46 so that the positions of these substrates are the same when viewed from the same side as one side surface.

Figure 16:
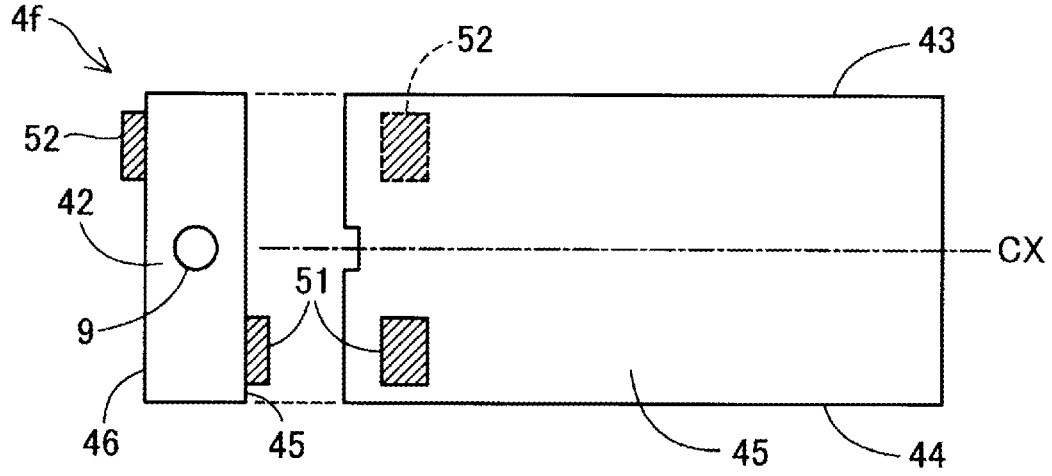
FIG. 16 illustrates an example of the layout of substrates in another cartridge.

In the example in FIG. 16, the first substrate 51 is disposed on the first side wall 45 of the cartridge 4*f* and the second substrate 52 is disposed on the second side wall 46 so that the distances from the front wall 42 to these substrates are the same and that the positions of these substrates are point-symmetric with respect to the liquid supply opening 9 when viewed from the same side as the front wall 42.

B-2

In the embodiment described above, the first contact 91 and second contact 92 have been disposed on their respective substrates. However, the first contact 91 and second contact 92 may be disposed directly on the surrounding wall 8.

B-3

In the embodiment described above, the first storage device 81 and second storage device 82 have been disposed on the rear surfaces of their respective substrates. However, the first storage device 81 and second storage device 82 may be disposed at positions other than on the rear surfaces of their respective substrates. For example, the first storage device 81 and second storage device 82 may be disposed inside or outside the surrounding wall 8.

B-4

In the embodiment described above, the central axis CX of the liquid supply opening 9 has extended in a direction along a horizontal plane. However, the central axis CX of the liquid supply opening 9 may extend in another direction. For example, the central axis CX may extend in a direction along the vertical direction or a direction inclined with respect to a horizontal plane.

B-5

In the embodiment described above, the first total and second total have been stored in the main body memory 232 as well. However, these values may not be stored in the main body memory 232. In addition, the first total, which is the amount of ink consumption in the first orientation, may be stored only in the first storage device 81 and the second total, which is the amount of ink consumption in the second orientation, may be stored only in the second storage device 82.

B-6

In the embodiment described above, specific information about the cartridge 4 has been stored in both the first storage device 81 and the second storage device 82, and first identification information and second identification information have been respectively stored in the first storage device 81 and second storage device 82. However, it is not always necessary to store these information items. These information items may not be stored in either of the first storage device 81 and second storage device 82.

B-7

In the embodiment described above, the cartridge 4 has been mounted in the holder 6 disposed in the main body case 212 of the printer 20. However, the cartridge 4 may be mounted in a holder disposed on the carriage 215. That is, the present disclosure can also be applied to the printer 20 of an on-carriage type without being limited to the printer 20 of an off-carriage type as in the embodiment described above.

B-8

In the embodiment described above, the cartridge 4 have had an ink pack as the liquid storage section 7. However, the cartridge 4 may have a chamber defined inside the surrounding walls 8 as the liquid storage section 7.

B-9

In the embodiment described above, four types of cartridges 4 have been mounted in the printer 20. However, the printer 20 may be structured so that one to three types or five or more types of cartridges 4 can be mounted.

B-10

In the embodiment described above, the first total and second total, each of which represents the total amount of ink consumption in one mounting orientation of the cartridge 4, have been stored in both the first storage device 81 and the second storage device 82. However, information indicating the amount of ink remaining in the cartridge 4 may be stored in both the first storage device 81 and the second storage device 82 instead of or besides the first total and second total.

B-11

The present disclosure is not limited to the printer 20 and the cartridge 4 in it, but can also be applied to arbitrary liquid ejecting apparatuses that consume a liquid other than inks and to liquid containers used in these liquid ejecting apparatuses. For example, the present disclosure can be applied as a liquid container used in various types of liquid ejecting apparatuses as described below.

(1) Image recording apparatuses such as facsimile machines (2) Color material ejecting apparatuses used to manufacture color filters for use in image display apparatuses such as liquid crystal displays (3) Electrode material ejecting apparatuses used to form electrodes in electroluminescence (EL) displays, field emission displays (FEDs), and the like (4) Liquid ejecting apparatuses that eject a liquid including bio-organic substances used in the manufacturing of biochips (5) Sample ejecting apparatuses used as precise pipettes (6) Lubricant ejecting apparatuses (7) Resin liquid ejecting apparatuses (8) Liquid ejecting apparatuses that eject a lubricant to a clock, a camera, or another precision machine at a particular point (9) Liquid ejecting apparatuses that eject a transparent resin liquid such as an ultraviolet curable resin liquid to a substrate to form a minute hemispherical lens (optical lens) or the like used in an optical communication element or the like

(10) Liquid ejecting apparatuses that eject an acidic or alkaline etching liquid to etch a substrate or the like

(11) Liquid ejecting apparatuses having a liquid ejecting head that discharges a very small amount of any other droplets The term "droplet" refers to a liquid discharged from a liquid ejecting apparatus in one of various states. Droplets in these states include a droplet in a granular state, a tear-like droplet, and a droplet tailing like a string. The liquid referred to here only needs to be a material that a liquid ejecting apparatus can consume. For example, the liquid may only need to be a material in a state in which the substance is in a liquid phase. Therefore, liquids also include materials in a liquid state that have high viscosity or low viscosity and other materials in a liquid state such as inorganic solvents such as sols, gel water, and the like, organic solvents, solutions, liquid resins, and metals in a liquid state (metallic melts). Not only liquids, which are in one state of substances, but also solvents in which particles of a functional material composed of pigments, metal particles, or another solid are dissolved, dispersed, or mixed are also included in liquids. Typical examples of liquids include liquid crystals and inks described in the above embodiments. Inks referred to here include ordinary water-based inks and oil-based inks as well as various types of liquid compositions such as gel inks and hot melt inks.

C. Other Aspects

The present disclosure is not limited to the embodiments described above. The present disclosure can be implemented in other various structures without departing from the intended scope of the present disclosure. For example, technical features, in the above embodiments, corresponding to technical features in aspects described below can be appropriately replaced or combined to solve part or all of the problems in the present disclosure or achieve part or all of the effects of the present disclosure. When these technical features are not described in this specification as being essential, the technical features can be appropriately deleted.

(1) A first aspect of the present disclosure provides a liquid container that, in a liquid ejecting apparatus having a holder, a liquid introducing section, and a holder-side terminal, is detachably mounted in the holder. This liquid container has: a liquid storage section storing a liquid; a surrounding wall enveloping the liquid storage section; a liquid supply opening formed in the surrounding wall, the liquid supply opening being configured to supply the liquid from the liquid storage section to the liquid introducing section; a first storage device configured to electrically couple to the holder-side terminal through a first contact section; and a second storage device configured to electrically couple to the holder-side terminal through a second contact section. The first contact section and second contact section are disposed at positions on the surrounding wall, the first contact section and second contact section being symmetric at the positions with respect to the central axis of the liquid supply opening. Even when the liquid container is rotated by 180 degrees around the central axis and is mounted in the holder, either of the first storage device and second storage device is coupled to the holder-side terminal. Information about the amount of the liquid is stored in both the first storage device and the second storage device.

In this aspect, even when the liquid container is reversely mounted in the holder in the liquid ejecting apparatus, information about the amount of liquid is stored in both the first storage device and the second storage device, so the amount of liquid in the liquid storage section can be correctly grasped.

(2) In the liquid container in the above aspect, the central axis may extend in a direction along a horizontal plane with the liquid container mounted in the holder. In this aspect, since the liquid container can be rotated around the central axis along the horizontal plane, the liquid in the liquid storage section can be efficiently agitated.

(3) In the liquid container in the above aspect, the first storage device may include a first storage area storing a first total, which is the total amount of liquid consumed from when the first storage device is coupled to the holder-side terminal, and may also include a second storage area storing a second total, which is the total amount of liquid consumed from when the second storage device is coupled to the holder-side terminal. The second storage device may include a third storage area storing the first total, and may also include a fourth storage area storing the second total. In this aspect, the first total and second total are stored in both the first storage device and the second storage device. Even when the mounting orientation of the liquid container is revered, therefore, the amount of liquid remaining in the liquid storage section can be correctly grasped.

(4) In the liquid container in the above aspect: when the first total is stored in the first storage area with the first storage device coupled to the holder-side terminal and then the second storage device is coupled to the holder-side terminal as a result of the liquid container being rotated, the first total may be stored in the third storage area in the second storage device; and when the second total is stored in the fourth storage area with the second storage device coupled to the holder-side terminal and then the first storage device is coupled to the holder-side terminal as a result of the liquid container being rotated, the second total may be stored in the second storage area in the first storage device. In this aspect, even when the liquid container is reversed and is mounted again, the amount of liquid remaining in the liquid storage section can be correctly grasped.

(5) In the liquid container in the above aspect, the first total and second total may be calculated by the liquid ejecting apparatus and may be written to both the first storage device and the second storage device through the holder-side terminal. In this aspect, since the amount of liquid consumption can be calculated by the liquid ejecting apparatus, the structure of the liquid container can be simplified.

(6) In the liquid container in the above aspect, the first storage device may store first identification information that identifies the first storage device and the second storage device may store second identification information that identifies the second storage device. In this aspect, the liquid ejecting apparatus can easily determine the mounting orientation of the liquid container.

(7) In the liquid container in the above aspect, the first storage device and second storage device may each store unique information about the liquid container. In this aspect, the liquid ejecting apparatus can correctly identify the liquid container regardless of the mounting orientation of the liquid container.

(8) A second aspect of the present disclosure provides a liquid ejecting system. The liquid ejecting system has a liquid ejecting head and the liquid container in the above first aspect, a liquid being supplied from the liquid container to the liquid ejecting head. In this aspect, even when the liquid container is reversely mounted in the holder in the liquid ejecting apparatus, information about the amount of liquid has been stored in both the first storage device and the second storage device, so the amount of liquid in the liquid storage section can be correctly grasped.

The present disclosure is not limited to aspects in the form of the liquid container and liquid ejecting system described above, but can be implemented as other various types of aspects such as a liquid ejecting apparatus and a method of managing the amount of liquid consumption.

What is claimed is:

1. A liquid container that, in a liquid ejecting apparatus having a holder, a liquid introducing section, and a holder-side terminal, is detachably mounted in the holder, the liquid container comprising:

a liquid storage section storing a liquid;

a surrounding wall enveloping the liquid storage section;

a liquid supply opening formed in the surrounding wall, the liquid supply opening being configured to supply the liquid from the liquid storage section to the liquid introducing section;

a first storage device configured to electrically couple to the holder-side terminal through a first contact section; and a second storage device configured to electrically couple to the holder-side terminal through a second contact section; wherein the first contact section and the second contact section are disposed at positions on the surrounding wall, the first contact section and the second contact section being symmetric at the positions with respect to a central axis of the liquid supply opening, even when the liquid container is rotated by 180 degrees around the central axis and is mounted in the holder, either of the first storage device and the second storage device is coupled to the holder-side terminal, and information about an amount of the liquid is stored in both the first storage device and the second storage device.

2. The liquid container according to claim 1, wherein the central axis extends in a direction along a horizontal plane with the liquid container mounted in the holder.

3. The liquid container according to claim 1, wherein:

the first storage device includes a first storage area storing a first total, which is a total amount of liquid consumed from when the first storage device is coupled to the holder-side terminal, and also includes a second storage area storing a second total, which is a total amount of liquid consumed from when the second storage device is coupled to the holder-side terminal; and the second storage device includes a third storage area storing the first total, and also includes a fourth storage area storing the second total.

4. The liquid container according to claim 3, wherein:

when the first total is stored in the first storage area with the first storage device coupled to the holder-side terminal and then the second storage device is coupled to the holder-side terminal as a result of the liquid container being rotated, the first total is stored in the third storage area in the second storage device; and when the second total is stored in the fourth storage area with the second storage device coupled to the holder-side terminal and then the first storage device is coupled to the holder-side terminal as a result of the liquid container being rotated, the second total is stored in the second storage area in the first storage device.

5. The liquid container according to claim 3, wherein the first total and the second total are calculated by the liquid ejecting apparatus and are written to both the first storage device and the second storage device through the holder-side terminal.

6. The liquid container according to claim 1, wherein:

the first storage device stores first identification information for identifying the first storage device; and the second storage device stores second identification information for identifying the second storage device.

7. The liquid container according to claim 1, wherein the first storage device and the second storage device each store unique information about the liquid container.

8. A liquid ejecting system comprising:

a liquid ejecting head; and the liquid container according to claim 1, a liquid being supplied from the liquid container to the liquid ejecting head.

* * * * *